US005110170A

United States Patent [19]

Boatwright

[11] Patent Number: 5,110,170

[45] Date of Patent: May 5, 1992

[54] COMBINATION PLATE AND CUP HOLDING APPARATUS

[75] Inventor: John c. Boatwright, 7310 Tavenner La., Alexandria, Va. 22306

[73] Assignee: John C. Boatwright, Alexandria, Va.

[21] Appl. No.: 584,630

[22] Filed: Sep. 19, 1990

[51] Int. Cl.[5] ..... A47G 19/08; B65D 6/04

[52] U.S. Cl. ..... 294/146; 294/172; 206/562; 220/23.83; D7/619

[58] Field of Search ..... 294/146, 159, 160, 172, 294/27.1, 31.2, 32; 220/23.83, 23.86; 206/217, 557, 558, 562, 563, 564, 565; D7/507, 543, 549, 554, 616, 619, 620, 622, 396.1

[56] References Cited

U.S. PATENT DOCUMENTS

| | | | |
|---|---|---|---|
| Re. 13,825 | 11/1917 | Blackwell . | |
| D. 214,641 | 7/1969 | Malakoff | D7/616 |
| 1,151,923 | 8/1915 | Blackwell . | |
| 2,411.864 | 12/1946 | Birkin . | |
| 2,916,188 | 12/1959 | Alger . | |
| 3,115,251 | 12/1963 | Farrell | 206/562 X |
| 3,598,278 | 8/1971 | Vann, Jr. | D7/396.1 X |
| 3,941,286 | 3/1976 | Perkinson | 294/172 |
| 4,461,396 | 7/1984 | Harper . | |
| 4,516,685 | 5/1985 | French . | |
| 4,607,758 | 8/1986 | Stevens . | |
| 4,785,959 | 11/1988 | Kleiner . | |

FOREIGN PATENT DOCUMENTS

| | | | |
|---|---|---|---|
| 1377826 | 12/1974 | United Kingdom | 294/146 |

*Primary Examiner*—Margaret A. Focarino
*Assistant Examiner*—Dean J. Kramer
*Attorney, Agent, or Firm*—Laubscher, Presta & Laubscher

[57] ABSTRACT

A combination plate and cup holding apparatus, comprising a plate support for supporting a plate, an arcuate retaining member secured to the plate support to receive therein and support the edge of the plate, a cup support secured to the annular retaining member for supporting a cup adjacent the edge of the arcuate retaining member, and a handle secured to the plate support and having one or more finger-grippable members which enable the apparatus to easily be held with one hand by finger-gripping the grippable members while the thumb rests on the edge of the plate, thereby continually urging the plate into the arcuate retaining member.

11 Claims, 2 Drawing Sheets

COMBINATION PLATE AND CUP HOLDING APPARATUS

BACKGROUND OF THE INVENTION

While dining, particularly in a buffet style environment, it is often necessary for the parties dining to hold a plate and a cup while traveling through a buffet line and/or while consuming the meal at a location with no access to a dining table. As a result, the parties are faced with the cumbersome task of attempting to hold a plate and a cup while serving themselves food and drink from a buffet table, and/or while consuming the meal. This situation hinders the enjoyment of such dining, and often results in food or drink being spilled. Therefore, a need has been created for a reliable and economical means for holding a plate and a cup with a single hand, thereby enabling a dining party to retain a free hand for serving and eating a meal.

The present invention was developed to address this need by providing a new and improved combination plate and cup holding device which enables a plate and a cup to be securely held with a single hand.

BRIEF DESCRIPTION OF THE PRIOR ART

Various combination plate and cup holders are known in the patented prior art as evidenced by the Birkin U.S. Pat. No. 2,411,864, Alger U.S. Pat. No. 2,916,180, and Kleiner U.S. Pat. No. 4,785,959.

The patent to Birkin discloses a circular frame plate holder with an integral retaining means and raised cup support. This device will only perform properly for very particular sized and shaped plates, and it also does not provide adequate support for a flexible plate.

The Alger patent, for example, discloses a plate and cup holder which includes a cup support, which also acts as a handle, a plate support frame, and a plate holding tongue member. While this device may work satisfactorily in some instances, it does not provide the necessary support and retaining means to securely hold a variety of plates. In addition, this device requires an auxiliary spring and hook member to continually urge the plate into the plate holding tongue member.

The patent to Kleiner discloses a combination plate and cup holding device which again does not provide the necessary support and retaining means for a flexible, particularly paper or plastic plate.

SUMMARY OF THE INVENTION

Accordingly, it is a primary object of the present invention to provide a reliable and economical combination plate and cup holding apparatus, which comprises plate support means for supporting a plate, an arcuate retaining member of sufficient length to retain a plate on the plate support means and also to provide additional support for the edge of a plate, cup support means for supporting a cup adjacent the edge of the arcuate retaining member, and handle means integral with the plate support means to enable the apparatus to be held with a single hand while securely supporting a plate and a cup.

According to a more particular object of the invention, the arcuate retaining member has an elongated wedge shaped opening, whereby the edge of the plate can be forced into the opening and frictionally retained therein.

Another object of the invention is to provide a handle means with a finger grippable member positioned under the plate and intermediate its edge thereof, whereby the apparatus may be held with a single hand by finger-gripping the grippable member while the thumb of the hand rests on the edge of the plate, thereby constantly urging the plate into the retaining member.

DESCRIPTION OF THE FIGURES

Other objects and advantages of the subject invention will become apparent from a study of the following specification when viewed in the light of the accompanying drawings, in which.

DETAILED DESCRIPTION

Figure 2:
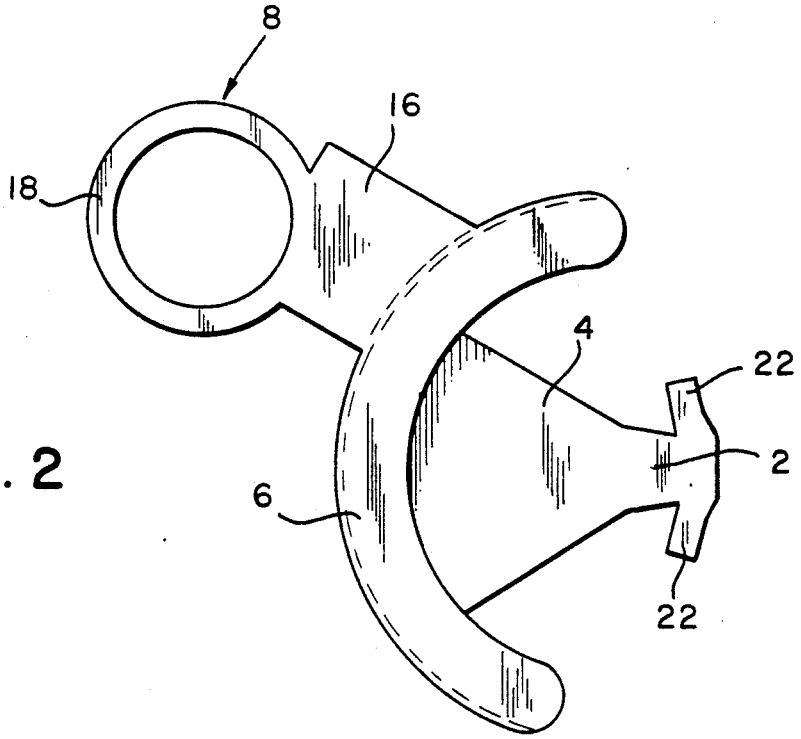
FIG. 2 is a top plan view of the apparatus.
Figure 3:
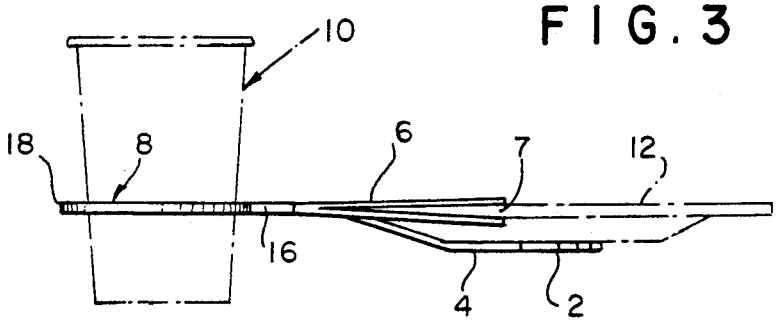
FIG. 3 is a side elevational view of the apparatus in use.

Referring to FIG. 2, there is shown a combination plate and cup holding apparatus comprising plate support means 4, an arcuate retaining member 6, cup support means 8, and handle means 2, all of which preferably are formed integrally out of any suitable material such as plastic, aluminum, stainless steel or the like.

Figure 1:
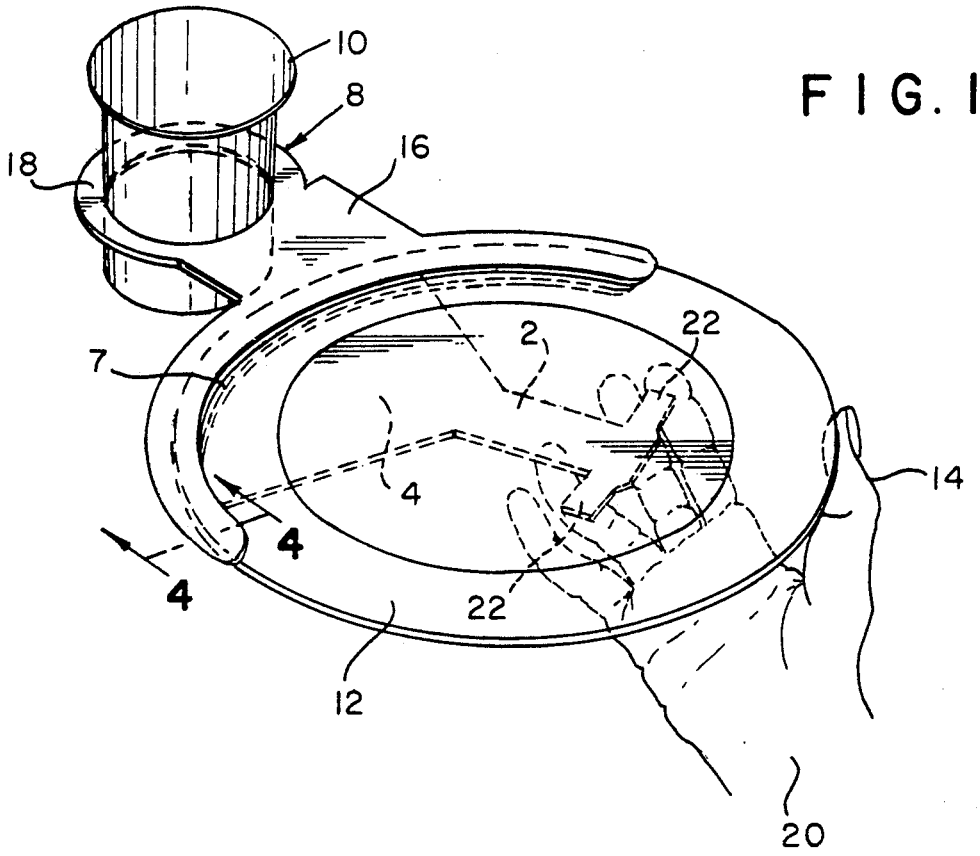
FIG. 1 is a perspective view of the apparatus in use.

Referring now to FIG. 1, there is shown the combination plate and cup holding apparatus with a plate 12 and a cup 10 supported thereon. The plate support means 4 may be in the form of a tapered platform which directly supports a portion of the plate 12.

The arcuate retaining member 6 is of sufficient length to retain the plate 12 on the plate support means 4, and to provide additional support for the edge of the plate 12 received therein. The retaining member 6 has an elongated wedge shaped opening 7 for receiving the edge of the plate 12, whereby the edge of the plate 12 can be forced into the opening 7 and frictionally retained therein. The term "arcuate" as used to describe the retaining member is meant not only to describe a partial circular shape, but also a partial octagonal, hexagonal, pentagonal, square, or the like shape in which a plate may be provided. As an illustrative example, a sufficient length for the arcuate retaining member 6 to securely retain the plate 12 is approximately 10% to 50% of the length of the perimeter of the plate 12.

The cup support means 8 includes a ring-shaped member 18 for receiving and supporting a cup 10 adjacent the edge of the arcuate retaining member 6, and an attachment member 16 of any suitable size or shape for attaching the ring-shaped member 18 to the arcuate retaining member 6. Alternatively, the ring-shaped member could be attached directly to the arcuate retaining member and at any desired location on the retaining member.

Handle means 2 are provided integral with the plate support means 4 to enable the apparatus to be held with a single hand 20 while supporting the plate 12 and cup 10. In one embodiment, the handle means 2 has a T-shaped finger-grippable member 22 positioned under the plate 12 and intermediate its edge thereof, whereby the apparatus may be held with a single hand 20 by finger-gripping the grippable member 22 while the thumb 14 of the hand 20 rests on the edge of the plate 12, thereby constantly urging the plate 12 into the arcuate retaining member 6.

Figure 4A:
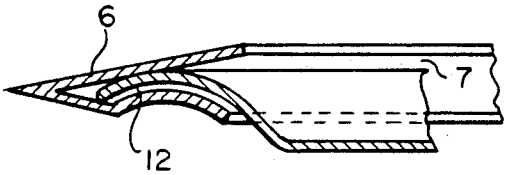
FIGS. 4*a* and 4*b* are cross-sectional views of two embodiments of the arcuate plate retaining means, with parts broken away.
Figure 4B:
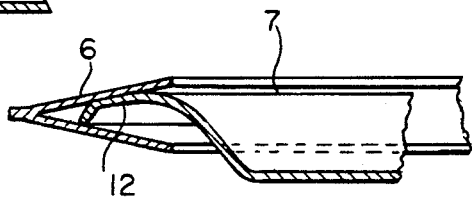

Referring now to FIGS. 4*a* and 4*b*, there are shown two embodiments of the arcuate retaining member 6, having an elongated wedge shaped opening 7, whereby the edge of plate 12 can be forced into the opening 7 and frictionally retained therein. The frictional force created between the edge of plate 12 and the retaining member 6 enables the plate to be securely retained on the plate support means 4, and provides additional support for the edge of plate 12. The additional edge support is of utmost importance in providing the necessary support for a flexible plate, such as a paper or plastic plate. In the embodiment of FIG. 4*b* the opening 7 is a V-shaped opening which enables the retaining member to receive a variety of plate edge shapes. In the embodiment of FIG. 4*a*, the opening 7 is shaped to conform with a particular plate edge shape, thereby enabling the plate 12 to be snap-fitted therein and retained with a maximum frictional force.

Figure 5:
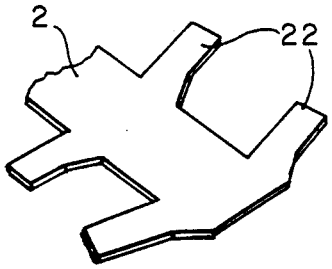
FIGS. 5 and 6 are partial perspective views of two alternative embodiments of the handle means.
Figure 6:
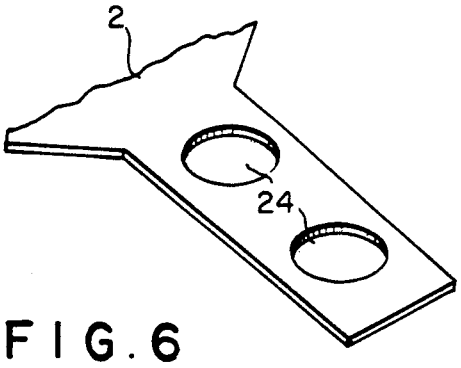

Referring now to FIGS. 5 and 6, there are shown two separate embodiments of the handle means 2. In the embodiment of FIG. 5 the handle means 2 includes a plurality of T-shaped finger grippable members 22. In the embodiment of FIG. 6, the handle means 2 includes an elongated member with a plurality of finger-grippable holes 24 therein. By providing a plurality of finger grippable members 22 or 24, the apparatus can easily be used by persons with different size hands.

While in accordance with the patent statute, the preferred forms and embodiments of the invention have been illustrated and described, it will be apparent to those of ordinary skill in the art that various changes and modifications may be made without deviating from the inventive concept set forth above.

What is claimed is:

1. A combination plate and cup holding apparatus, comprising:

(a) plate support means for supporting a plate thereon, said plate support means having a platform member defining a plane for directly supporting a portion of the bottom of a plate thereon;

(b) an arcuate retaining member secured to said plate support means and adapted to receive therein and support the edge of a plate, said retaining member being of sufficient length to retain the plate on said plate support means;

(c) cup support means secured to said retaining member for supporting a cup adjacent the edge of said retaining member; and (d) said platform member having an inner portion and extending inwardly from said retaining member, and handle means secured to the inner portion of said platform member and extending substantially in said plane defined by said platform member to enable said apparatus to be held with a single hand by finger-gripping said handle means while the thumb of the hand rests on the adjacent edge of the plate to retain the plate in said retaining member.

2. Apparatus as defined in claim 1, wherein said apparatus is integrally formed of plastic material.

3. Apparatus as defined in claim 1, wherein said platform member is tapered inwardly away from said retaining member.

4. Apparatus as defined in claim 1, wherein said retaining member is of a length that is approximately 10% to 50% of the length of the perimeter of the plate.

5. Apparatus as defined in claim 1, wherein said retaining member has an elongated wedge shaped opening, whereby the edge of a plate can be forced into said opening and frictionally retained therein.

6. Apparatus as defined in claim 5, wherein said wedge shaped opening is shaped as to conform with the edge of said plate, to enable said plate to be snap-fitted and retained therein with a frictional force.

7. Apparatus as defined in claim 1, wherein said cup support means includes a ring-shaped member for receiving and supporting a cup therein, and an attachment member for attaching said ring-shaped member to said retaining member.

8. Apparatus as defined in claim 1, wherein said handle means has a finger-grippable member positioned under said plate and intermediate the edge thereof.

9. Apparatus as defined in claim 8, wherein said finger-grippable member is a T-shaped member, whereby the T-shaped member may be gripped by at least one finger.

10. Apparatus as defined in claim 8, wherein said finger-grippable member is an elongated member with at least one hole therein, to enable the elongated member to be gripped by at least one finger.

11. Apparatus as defined in claim 8, wherein said handle means includes a plurality of finger-grippable members, to enable the apparatus to be held by persons with different size hands.

* * * * *